US005934624A

United States Patent [19]

Suk

[11] Patent Number: 5,934,624

[45] Date of Patent: Aug. 10, 1999

[54] GOLF BAG LEG SUPPORT

[76] Inventor: Young J. Suk, P.O. Box 591 / 34 Garvies Point Rd., Glen Cove, N.Y. 11542

[21] Appl. No.: 09/160,261

[22] Filed: Sep. 25, 1998

Related U.S. Application Data

[63] Continuation of application No. 08/214,624, Mar. 18, 1994, abandoned.

[51] Int. Cl.[6] ..... A63B 55/00

[52] U.S. Cl. ..... 248/96; 206/315.7

[58] Field of Search ..... 248/96, 167, 168, 248/169, 171, 297.21, 688; 206/315.3, 315.7, 315.8

*Primary Examiner*—Ramon O. Ramirez
*Assistant Examiner*—Gwendolyn Baxter
*Attorney, Agent, or Firm*—Myron Amer PC

[57] ABSTRACT

Embodiments (two) of a tripod golf bag stand in the second embodiment which the leg mechanism bypass positioning function of the base plate is adapted for use both on a larger man's-sized golf bag and on a smaller lady's-sized golf bag using an elongated slot, rather than a drill hole, to correspondingly accommodate the larger and the lesser ascending sliding movement of the leg mechanism slide which establishes the conditions for the bypass. For the man's-sized golf bag, the bypass position is adjacent the top of the slot and for the lady's-sized golf bag is adjacent the bottom of the slot; the slot size thus accounting for the slide movement differences and obviating having to use different mounted positions for the plate.

1 Claim, 6 Drawing Sheets

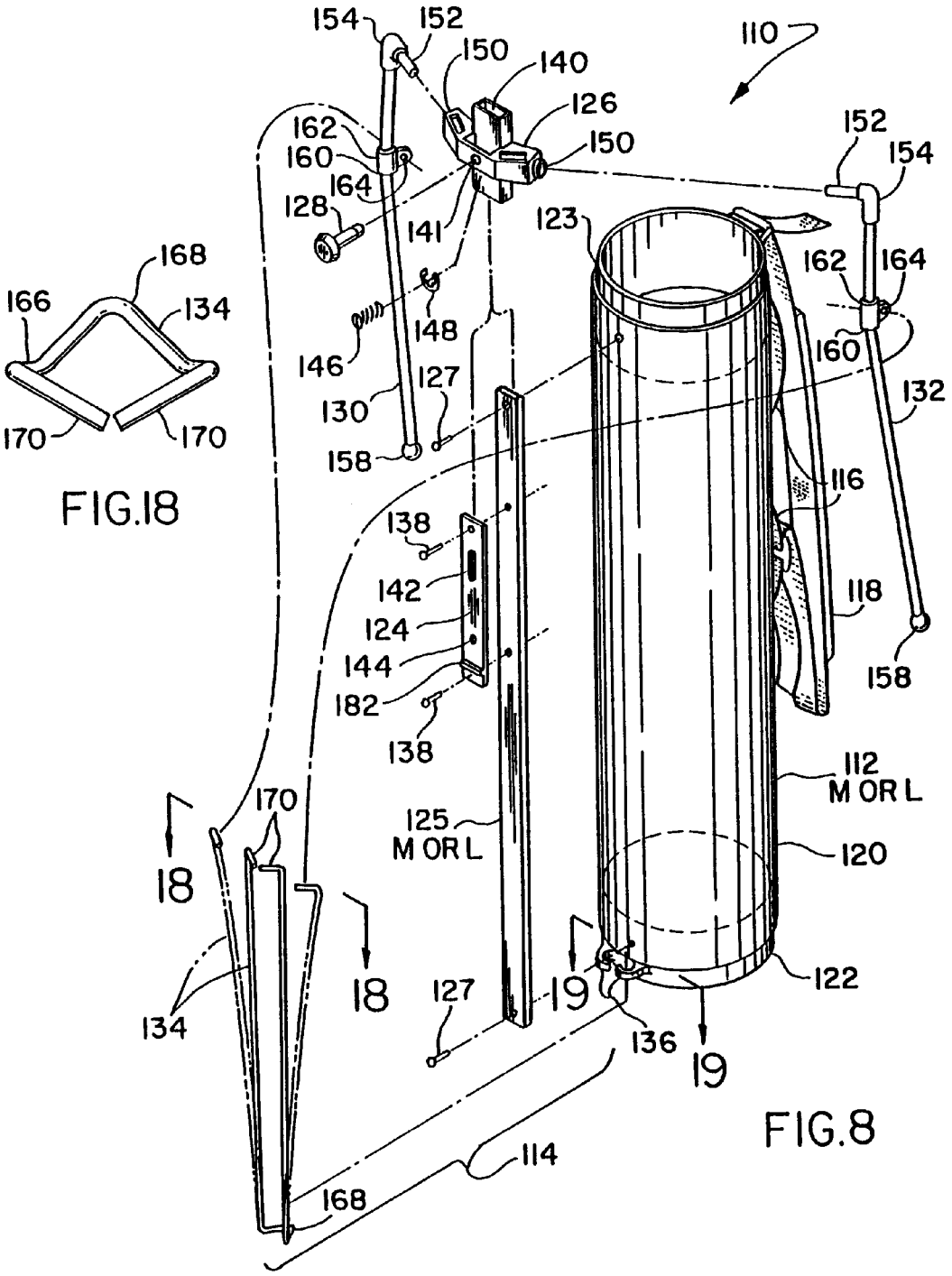
FIG.18
FIG.8
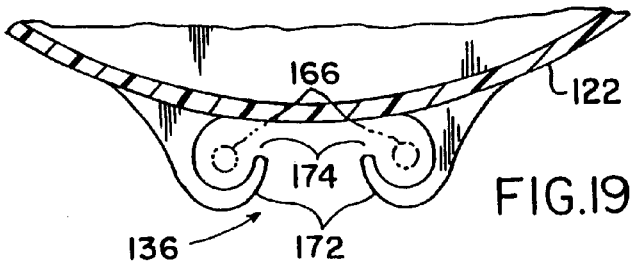
FIG.19

GOLF BAG LEG SUPPORT

This is a continuation of application Ser. No. 08/214,624, filed Mar. 18, 1994 now pending.

The present invention relates generally to improvements for a golf bag stand, and more particularly to improvements for a popularized aptly characterized two-position golf bag stand in which the golfer has the option of either using or bypassing the use of the leg mechanism of the stand, depending on an operative position of the leg mechanism. The option noted requires movement of a slide, and according to the present invention significant structural features are embodied in the stand to control the tracking of the slide during its movement, to correspondingly significantly enhance the use of the golf bag stand.

EXAMPLE OF THE PRIOR ART

It is already known in the prior art, as exemplified by U.S. Pat. No. 4,620,682 issued to Byung D. Yim on Nov. 4, 1986, to provide a golf bag stand formed as a tripod arrangement of the golf bag and two spread apart angularly oriented legs. In the Yim patent, the leg mechanism is adapted to be moved from an upper to a lower operative position, so that contact with the ground actuates the legs from their normally closed positions against the bag into their open bag-supporting positions. When the support provided by the legs is not needed, as when the golf bag is carried on a golf cart, the leg mechanism is raised to its upper position.

While the popularity of the prior art two-position golf bag stand, providing the option of using or bypassing the use of the legs, is significant, the sliding or shifting movement of the leg mechanism required for the optional operational mode contributes to malfunctioning heretofore not satisfactorily obviated. In Yim, for example, a leg mechanism slide member slides along a vertically oriented shaft or rod and has the legs connected to extend from opposite sides thereof and uses a threaded member to engage the rod to hold its positions of movement therealong. The contact of the threaded member directly against the rod and the forces transmitted through the legs and correspondingly imparted against the opposite ends of the slide member, together with normal abuse unavoidable in the use of the golf bag and other factors, contribute to malfunctioning, particularly that manifested as angular deflection in the slide member and, thus, in difficulty in its partaking of unimpeded sliding movement along the rod between its upper and lower operative positions.

Broadly, it is an object of the present invention to provide a first embodiment tripod-type golf bag stand with the described leg use or non-use option, overcoming the foregoing and other shortcomings of the prior art.

More particularly, it is an object to have in said first embodiment the leg-opening slide member track along a raised rectangular configuration and through two adjacent parallel path-defining grooves, to thereby maintain sliding movement in a substantially vertical direction with minimum angular deflection. The two operative positions of movement are established by contact with the rectangular configuration without adverse effect, and the within improvements provide other noteworthy benefits, all as will be better understood from the detailed description of said first embodiment which follows.

To use to maximum advantage the leg-opening operating mode for a golf bag, there is herein provided in a second embodiment means enabling the same leg-opening mechanism for both a lady's-sized and man's-sized golf bag, which different sized golf bags heretofore required different leg-opening mechanisms, to account in the latter man's sized golf bag for the fact that the bag is longer and the golf clubs heavier.

The description of the invention which follows, together with the accompanying drawings, should not be construed as limiting the invention to the examples shown and described, because those skilled in the art to which this invention appertains will be able to devise other forms thereof within the ambit of the appended claims.

Figure 4:
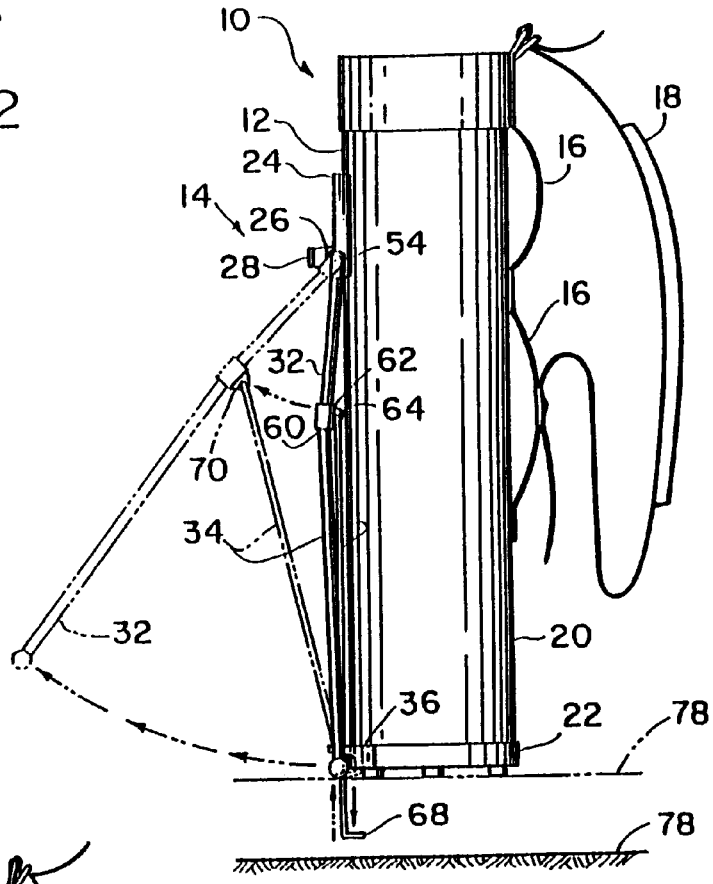
FIG. 4 is a right side elevational view of the stand with the leg mechanism in its lower operative position, and illustrating the opening leg movement from its closed position against the golf bag shown in full line perspective into its bag-supporting position shown in phantom line perspective.
Figure 5:
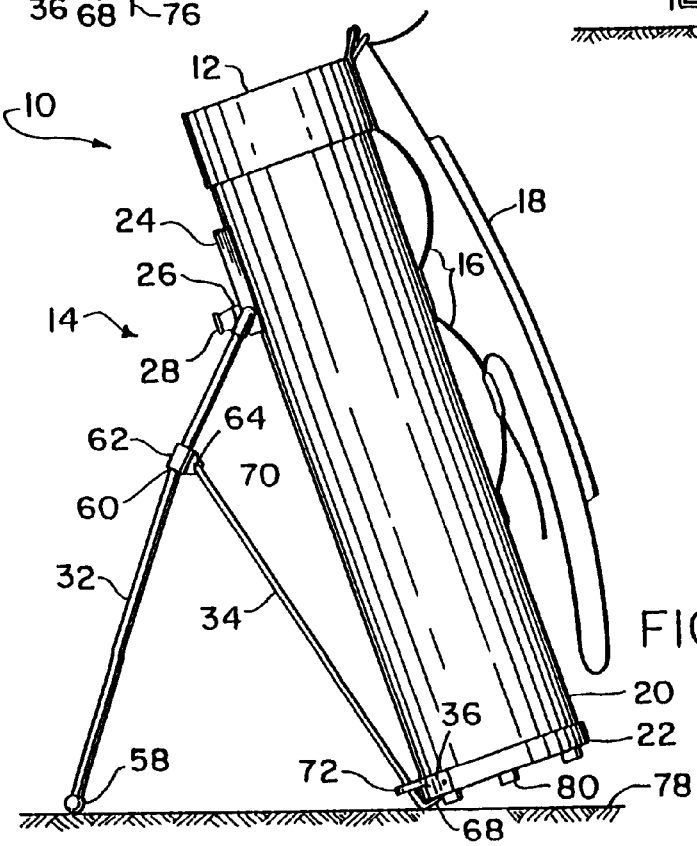

FIG. 5, like FIG. 4, is similarly a right side elevational view of the stand with the leg mechanism in its bag-supporting position shown in full line perspective.

Figure 6:
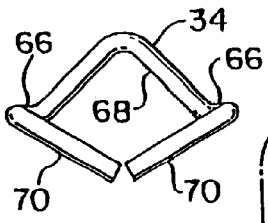
Figure 1:
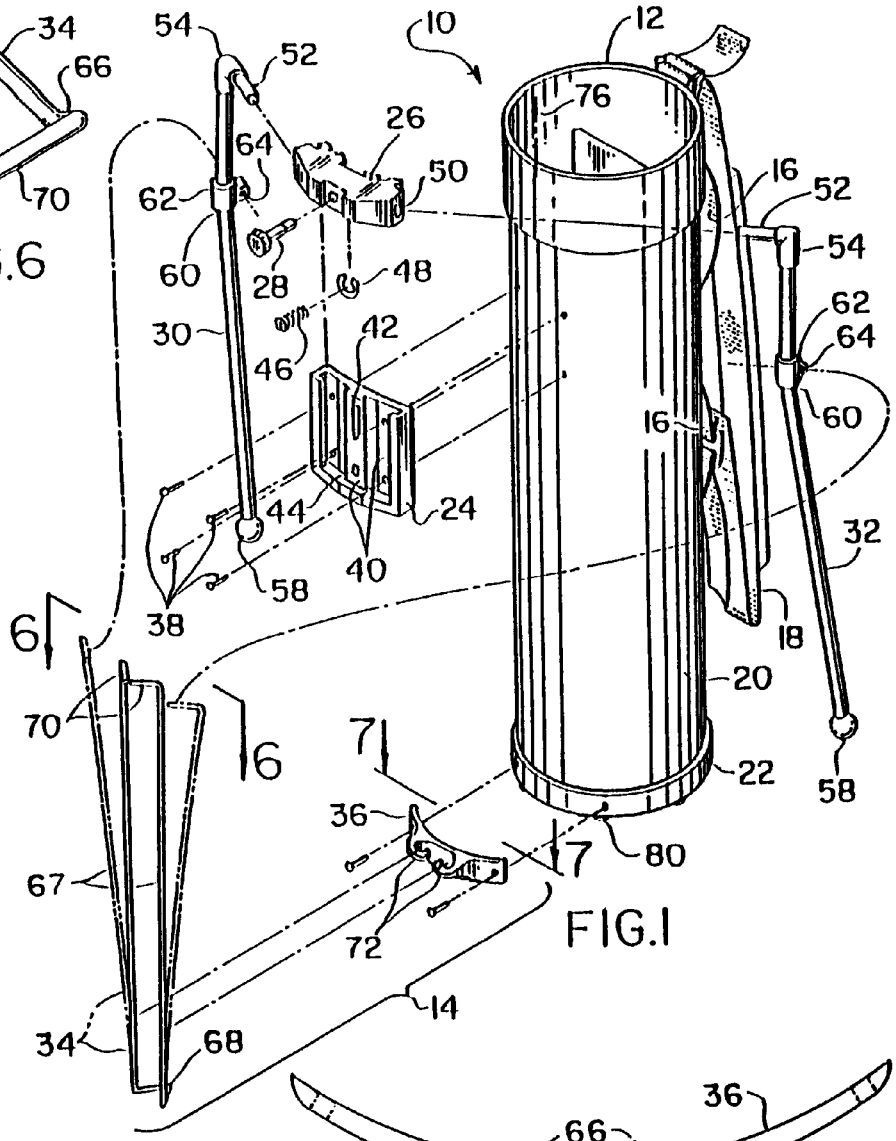
FIG. 1 is an exploded perspective view of the within inventive first embodiment of a two-position golf bag stand showing the components thereof in unassembled relation, further details of which are in shown FIGS. 2–7.
Figure 7:
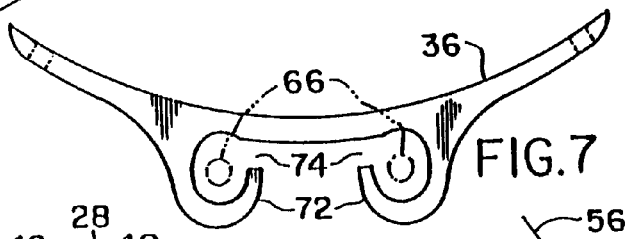
Figure 9:
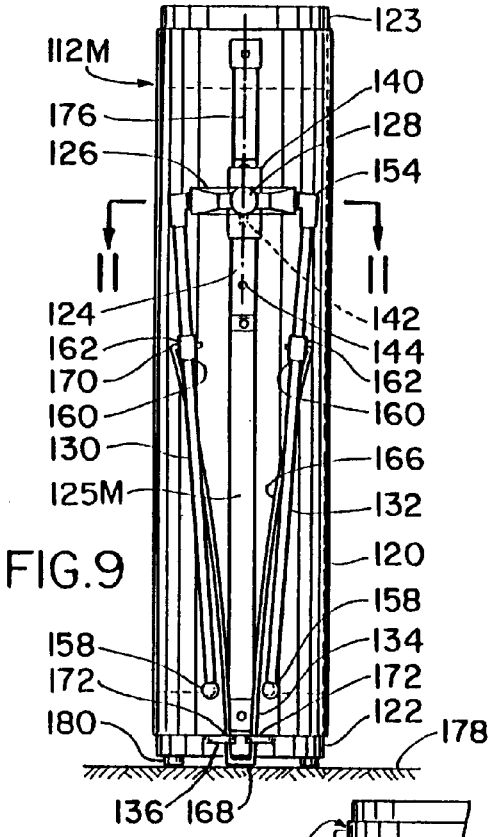
Figure 10:
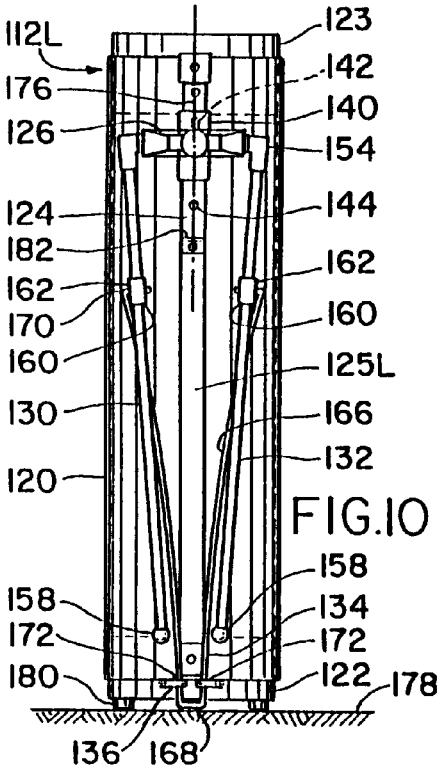
Figure 12:
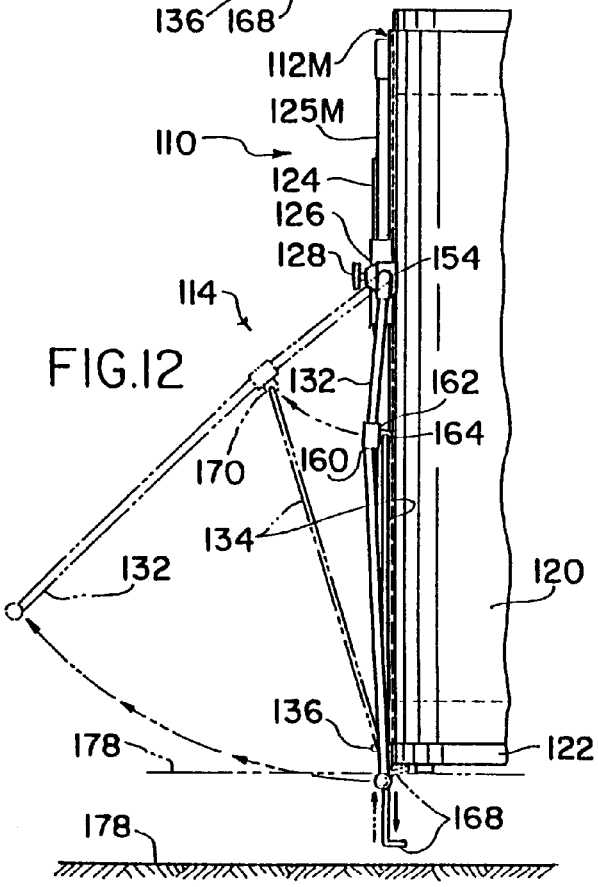
Figure 13:
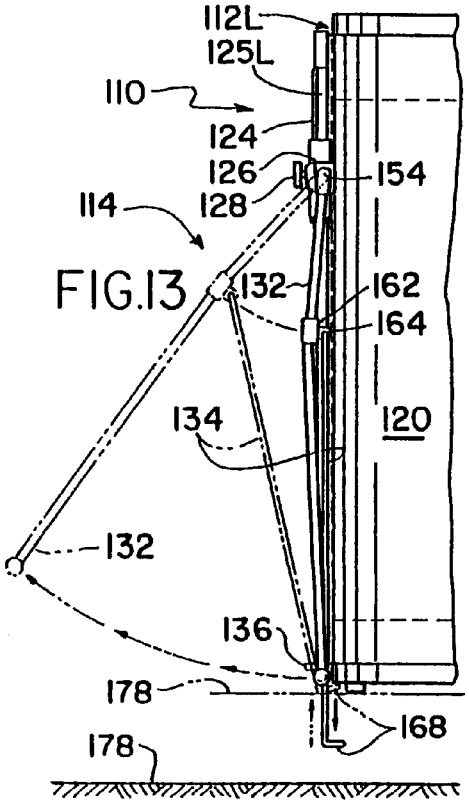
Figure 14:
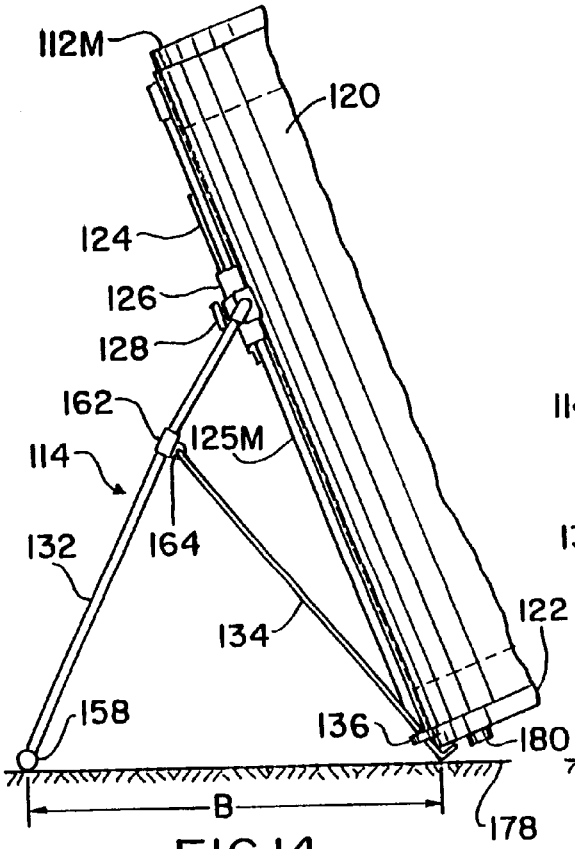
Figure 15:
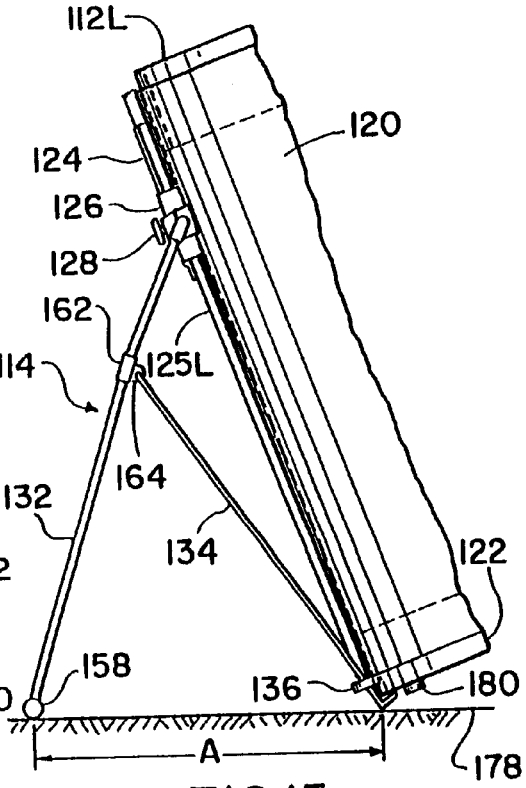
Figure 11:
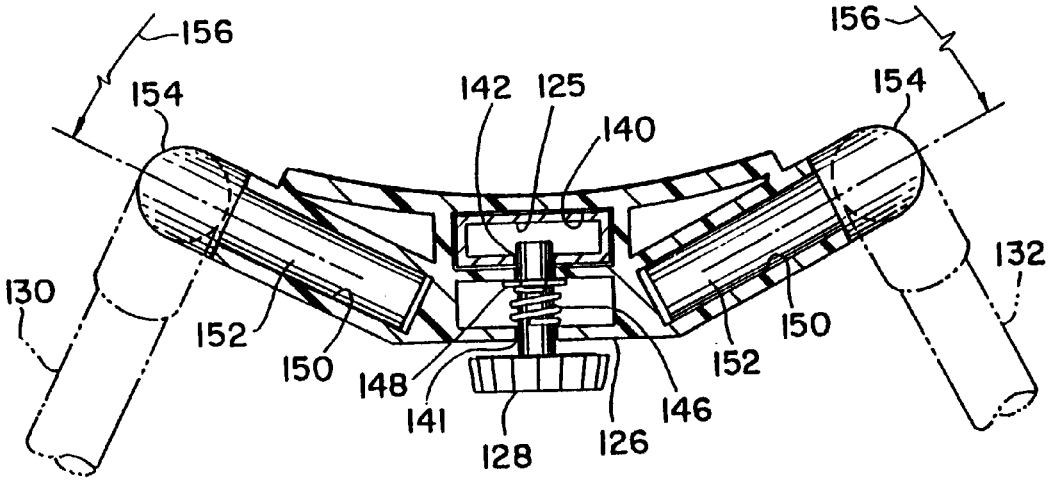
Figure 16:
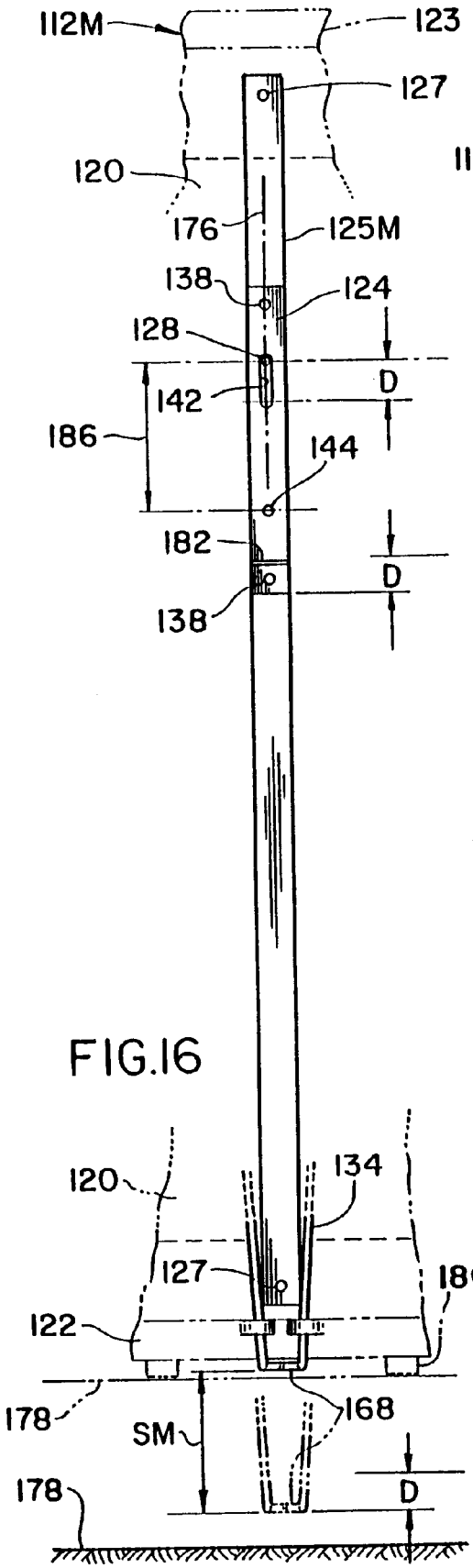
Figure 17:
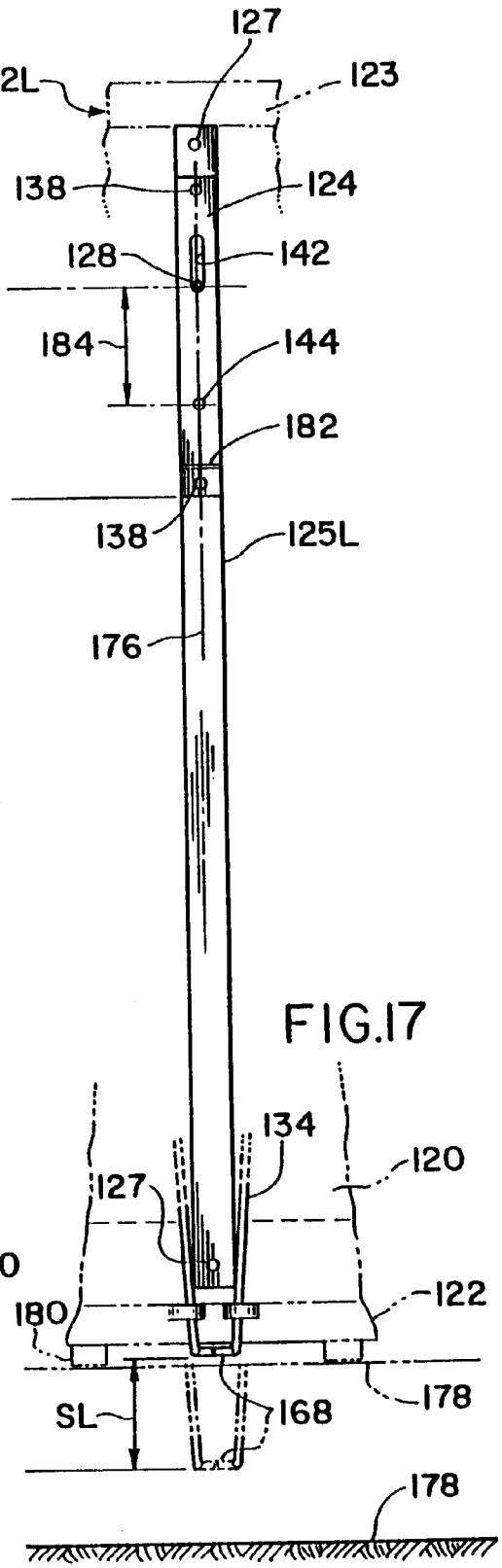

FIG. 6 is a detailed view taken along line 6—6 of FIG. 1 of the vertically moveable lower end of the leg actuating member;

FIG. 7 is a detailed view taken along line 7—7 of a guide cooperating with the leg actuating member during the vertical movement thereof;

Remaining FIGS. 8–19 illustrates the second embodiment of the within inventive golf bag leg support wherein more particularly, FIG. 8 is an exploded perspective view showing the components thereof in unassembled relation;

FIG. 9 is a front elevational view of a man's sized golf bag of the fully assembled stand with the leg mechanism thereof in its upper operative position bypassing use of the legs;

FIG. 10 is a front elevational view similar to FIG. 9, but of a lady's-sized golf bag;

FIG. 11 is an enlarged scale sectional view taken along line 11—11 of FIG. 9;

FIG. 12 is a partial right side elevational view, with the leg positions of movement shown in full line and phantom line perspective, of the man's-sized golf bag of FIG. 9;

FIG. 13 is a view similar to FIG. 12, but of a lady's sized golf bag;

FIG. 14, like FIG. 12, is another partial right side elevational view of the man's-sized golf bag of FIG. 9;

FIG. 15 is a view similar to FIG. 14, but of a lady's-sized golf bag;

FIG. 16 and FIG. 17 are each respectively simplified schematic views of the mounting structures for leg-opening mechanisms for the men's and lady's sized golf bags;

FIG. 18 is an isolated view of a cantilever spring, similar to FIG. 6, as seen from the perspective taken along line 18—18 of FIG. 8; and FIG. 19 is a sectional view taken along line 19—19 of FIG. 8.

FIRST EMBODIMENT

As perhaps is best understood from FIG. 1, the within inventive stand of the present invention, generally designated 10, is assembled to a conventional golf bag 12 to provide, during golfing use of the bag, an automatically actuated leg support mechanism 14, which can be manually adjusted between upper and lower operative positions, to provide the golfer with the option, when in its upper position, of bypassing use of the legs, and, in its lower position, with using the legs in the manner shown in FIGS. 4 and 5, to form a tripod arrangement or support stand which holds the golf bag 12 in an erect position for the convenience of the golfer, all as will be explained in greater detail as the description proceeds.

Golf bag 12 is fitted with the usual hand grips 16 and adjustable padded carrying strap 18. Diametrically opposite the handles 16 and strap 18 there is allotted space adjacent the top of the bag 12 for the mounting of the leg mechanism 14. The outfitting of the bag 12 includes customary zippered bags and pouches (not shown) which are stitched about the remaining surface of the side wall 20 of bag 12. Wall 20 has a bottom, pan-like, closure member 22 rivetted, or otherwise secured thereto.

Figure 2:
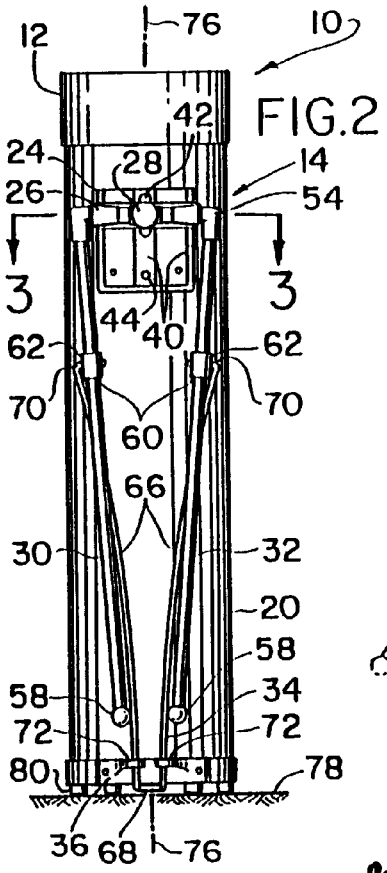
FIG. 2 is a front elevational view of the fully assembled stand with the leg mechanism thereof in its upper operative position bypassing use of the legs.

Continuing with the description with specific reference to FIG. 1, it will be noted that leg mechanism 14 is comprised of a base plate 24, which functionally is a slide bracket in that it is the component upon which a slide of the leg mechanism tracks, a slide 26 cooperating with the slide bracket or member 24, which is part of the leg stand mechanism, and, in fact, is the component required to assume the upper and lower operative positions to provide respectively the non-use and leg use operational modes, a lock pin 28, a left leg assembly 30, a right leg assembly 32, a dual cantilever spring 34 and a spring bearing guide 36. Base plate 24 is appropriately slightly curved to facilitate its being fitted to a correspondingly curved bag support surface 20 to which it is attached by an array of rivets 38. In this location, base plate or slide bracket 24 advantageously presents to the slide 26 a dovetailed track and guide means 40 for maintaining substantially vertical movement of slide 26 while partaking of sliding movement between an upper elongated slot 42 coincident with an upper operative slide position, and a lower detent hole 44 coincident with a lower operative slide position. In the upper operative position of slide 26, as shown in FIG. 2, the use of the legs is bypassed, while in the lower operative position, as shown in FIG. 4, the legs are actuated to provide support for the bag 12 as intended and shown in FIG. 5. To hold slide 26 in a selected one of its two possible positions, slide 26 is designed to receive lock pin 28 for cooperative engagement within either a detent pin receiving chamber 44 or elongated slot 42 in plate 24. A biasing spring 46 and a C-ring 48 are used to urge pin 28 to engage opening 42 or 44. Additionally, slide 26 is provided with right and left end openings 50 to receive the inward extending axial ends 52 of right angle fittings 54 on the upper ends of legs 30, 32. Openings 50 are arranged to be at an obtuse angle 56 of approximately 120°, so that legs 30, 32 will take a radial orientation in their extended position as seen in phantom perspective in FIG. 3. On the lower ends of legs 30, 32 a plastic ball or foot 58 is press fitted thereon. Legs 30, 32 themselves are preferably made of ½" diameter lightweight metal tubing. At a point 60, about ¼ their length from the upper end, legs 30, 32 are provided with an angular crook or knee. Also at point 60, a ferrule 62 is riveted or otherwise fastened to each of the legs 30, 32. Ferrules 62 each internally bound a through bore 64. At assembly to receive legs 30, 32, the ferrules 62 are oriented to align with respective bores 64 that are parallel to horizontally oriented upper leg ends 52 projected through fittings 54, and are also aligned with upper ends 70 on spring 34, the significance of which will soon be apparent.

Spring member 34, made of heavy gauge spring wire, is formed as a pair of essentially parallel cantilevers 66 about a foot 68. The upper ends 70 of cantilevers 66 are additionally formed at right angles to the shaft 66 and at an appropriate angle in a horizontal plane to correspondingly align with bores 64 to permit the assembly on the legs of the leg ferrules 62.

A spring bearing guide 36, preferably of plastic construction material is, as best seen in FIGS. 1 and 7, reveted to, or optionally molded as part of closure member 22, to the bottom end of wall 20. At assembly, cantilevers 66 are snapped within a pair of open guide members 72 formed with oversized openings 74 to facilitate this assembly.

When all components of the within leg support mechanism 14 shown in FIG. 1 are assembled symmetrically about a vertical center line 76 on golf bag 12, the resulting construction appears as shown in FIG. 2.

It is appropriate at this point in the description to note that cantilevers 66 are spread apart a considerable distance, and thus provide a lateral force against ferrules 62 which, in turn biases the inturned ends 52 on legs 30, 32 into firm contact with the surfaces bounding the bearing socket openings 50 in slide 26. Mechanism 14 as shown in FIG. 2 will be understood to be in its passive mode wherein pin 28 is engaged within slot 42 which consequently holds slide 26 and, thus, the legs 30, 32 and spring 34, including the foot or depending end 68 thereon, in a raised position unable to make contact with the ground. When bag 12 is thus standing vertically on the ground or a surface 78, the foot 68 is held within a space provided by standoff extensions 80 on the bottom surface of closure member 22. In this passive mode, device 10 can be placed on a golf cart, or otherwise used without leg supports and the space that the open leg supports and the space that the open leg support would require.

To bring leg mechanism 14 into its active mode, device 10 is lifted above surface 78, as shown in FIG. 4 in solid line perspective, while point 28 is retracted from slot 42 and relocated in detent hole 44, thus lowering slide 26 and extending foot 68 beneath the bottom of the bag 12. In this leg mechanism condition bag 12 is readily portable between golf shots with legs 30, 32, if desired, in their non-extended position. When device 10 is placed on the ground or support surface 78, shown in phantom perspective in FIG. 4, the weight of bag 12 causes rod like cantilevers 66 to extend both legs 30, 32, much in the manner in which a knee brace pushes its cooperative respective spoke away from the hub shaft upon opening an umbrella. It is to be noted that, when legs 30, 32 are fully extended, the upper ends 70 of cantilevers 66 are spread even further apart than when legs 30, 32 are in their retracted position. This arrangement provides the necessary bias to return legs 30, 32 to their retracted position when bag 10 is again lifted from surface 78. When the legs are extended, the user then places device 10 into the position shown in FIG. 5 wherein ball feet 58 on legs 30, 32 and foot 68 on spring 34 contact surface 78 forming a three-point or tripod stand that is stable, and holds the bag 12 erect to enable the golfer to conveniently remove a selected golf club.

From the foregoing description it should be readily understood that, in the open stand position of FIG. 5 of the bag and its golf club contents, as a function of the supported weight that there is transmitted longitudinally of the legs 30, 32 a force which is imparted or applied to the opposite ends of slide 26, which has a tendency to deflect the slide 26 from a desired horizontally oriented position. This tendency or torque force over a period of use, in conjunction with other factors, ultimately adversely effects the tracking of slide 26 between its upper (FIG. 2) and lower (FIG. 4) operative positions. Thus, underlying the present invention are construction improvements in the slide bracket 24 and slide 26 to obviate this tracking problem.

Figure 3:
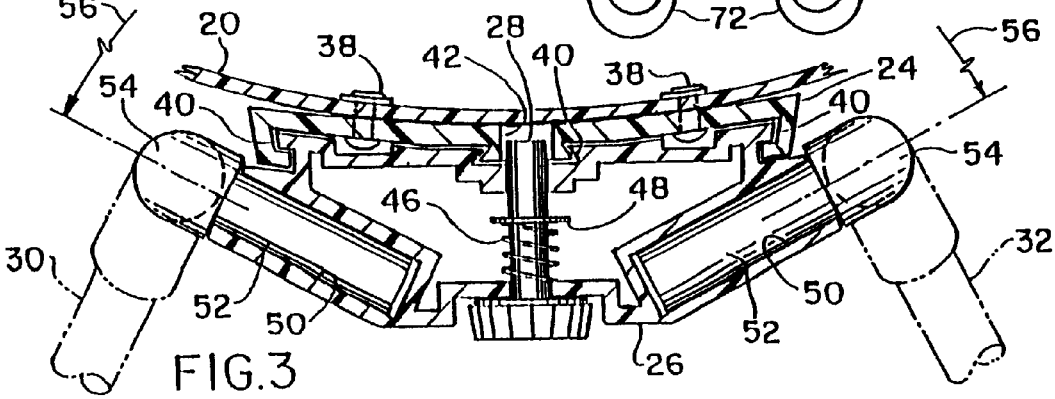
FIG. 3 is an enlarged scale cross sectional view taken along line 3—3 of FIG. 2.

More particularly, and as may be readily noted in the enlarged scale cross sectional view of FIG. 3, bracket 24 for the slide 26 has a curved rear surface conforming to the curved support surface of bag 12 to facilitate the rivet attachments 38 thereto. Slide bracket 24 in its mounted position presents forwardly projected opposite sides 40, and in a central location, a raised rectangular configuration or section 40. Thus, between each opposite side of bracket 24 and the facing side of the medial rectangular configuration there are formed two parallel vertically oriented tracks, designated 40 in FIGS. 1 and 3.

Slide 26 has spaced apart projections 26A which align with, and in practice project into, the tracks 40 of bracket 26, and a medial connecting or spanning portion or section 26B coextensive with the spacing of the projections which is sized and rectangularly shaped to be placed in covering relation over the slide bracket medial section 40. The interfitting of the rectangular shape bounded by the projections 26A and surface 26B over the raised medial section 40 of slide bracket 24 obviates any angular deflection tendency in the slide 26, and thus contributes to unimpeded sliding movement of slide 26.

While the within two-position golf bag stand, herein shown and disclosed in detail, is fully capable of attaining the objectives and providing the advantages hereinbefore stated, it is to be understood that it is merely illustrative of the presently preferred embodiment of the invention, and that no limitations are intended to the detail of construction or design herein shown other than as defined in the appended claims.

SECOND EMBODIMENT

More particularly, a specific modification to be considered within the scope of the within invention that is contemplated to the illustrative first embodiment of FIGS. 1–7 is shown as a second embodiment in FIGS. 8–19, to which reference should now be made.

As already noted, the second embodiment illustrates advantageous use of the operating mode of the leg-opening mechanism of the first embodiment so that it can be applied to both a man's-sized and a lady's-sized golf bag. Referring to FIG. 2, this objective can be achieved by proper positioning of the leg mechanism 14 base plate 24 wherein to get the wider leg spread to properly support the larger and heavier weight of the men's-sized bag the base plate 24 should be attached approximately ½ inch lower than its FIG. 2 position, and to properly support the smaller and lighter lady's-sized golf bag a proper position for the plate 24 would be ½ inch higher than its FIG. 2 position. Although this is a simple solution accomplishing the objective noted, it nevertheless contemplates different mounted or operative positions for the base plate 24. As will now be explained, in the second embodiment a single leg-opening mechanism base plate 124 having the same and thus a single mounted operative position, i.e. not even the ½ inch above and ½ below positions relative to the FIG. 2 position, on both the man's-sized and the lady's-sized golf bags is effective to provide proper support for these different sized golf bags. This, is an obvious manner, obviates mistakes and errors in the assembly of the leg-opening mechanism 114 to the two sizes of golf bags 120.

To the extent that the crux of the inventive advance which expands the utility of the leg-opening mechanism base plate 24 of the first embodiment, which in the second embodiment is designated with the same number, but in the 100 series, i.e. as component 124, can be summarized or pin-pointed, it resides in using, as may be best understood form FIGS. 8, 16 and 17, a lower leg mechanism positioning drill hole 144 or equivalent function to hole 44, and instead of a similar drill hole in an upper position of equivalent function to hole 42, an elongated lengthwise oriented slot 142. The length dimension of slot 142 allows for the ½ inch up and down positions of movement previously noted for base plate 24 in relation to FIG. 2. Stated another way, instead of having to change the FIG. 2 position of base plate 24, a single mounted position is selected for the equivalent functioning base plate 124 and the slot 142 length D (FIG. 16) allows for the by-passing of the leg-opening mechanism for both the man's sized and the lady's-sized golf bags 120.

Although it is believed that the patentable advance of the second embodiment of FIGS. 8–19 should be readily understood from the preceeding explanation and description, for completeness' sake significant aspects of the construction and operating mode of the leg-opening mechanism 114 will be discussed that might contribute to an understanding of said patentable advance. However, on the other hand, for brevity's sake and as unnecessary to an understanding of the patentable advance, the description of structural details and operating mode embodied in the second embodiment and already described in connection with the first embodiment will not again be described, and will be designated by the same reference numerals, but in the 100 series.

As may be best understood from FIGS. 12 and 13 which are positioned side-by-side to facilitate their being considered conjointly, the leg mechanism 114 both for the man's-sized golf bag 120 (FIG. 12) and the lady's-sized golf bag 120 (FIG. 13) contemplates ascending movement, as noted by the arrows with the dash-dot lines, in the bottom feet 168 of the slide 126 arranged for tracking movement along the tracks 125M, 125L of the two golf bags. It is the extent of the ascending movements of the feet or ground-contacting bottoms 168, as denoted by the positions of movement in full line and phantom line perspective in the lead lines of reference numerals 168 and also respectively denoted SM and SL in FIGS. 16, 17 that determines the breadth or size of the tripod stand of FIGS. 14 and 15, wherein distance B is, as it is required to be, larger or greater than distance A, and is a consequence of the larger or lesser overhangs 168 as noted in FIGS. 12 and 13 for the different sized golf bags 120.

In FIGS. 12 and 13 the slides 126 of each golf bag leg mechanism 114 are in the lower leg-opening operative positions in which the lock pins 128 are in the bottom base plate openings 144 the locations of which are best illustrated in FIGS. 16, 17, said base plates 124 being mounted at a selected position that is the same on each golf bag on their cooperating tracks 125 as may be readily noted in comparison FIGS. 14 and 15.

To bypass the leg-opening mechanism 114, the overhangs 168 must be removed, and this necessitates ascending sliding movement in the slides 126 along their cooperating tracks 125. To use the same base plate 124 for both golf bags in the same mounted or position of assembly to the upper portion of the tracks 125 as noted in FIGS. 14, 15, the upper slide position-establishing structural feature on the base plate 124 must accommodate the larger overhang distance SM and also the smaller distance SL, the difference therebetween being the distance D noted in FIG. 16. This is achieved by using a slot 142 having a lengthwise demension equal to the distance D. Thus, and as may be best understood from FIGS. 16 and 17, after ascending movement of the slides 126 to their leg-bypassing positions of movement, the lock pin 128 for the man's-sized golf bag positions itself adjacent the top of slot 142 (FIG. 16) and the lock pin 128 for the lady's-sized golf bag adjacent the bottom of the slot.

While the apparatus of the within inventive second embodiment of the tripod golf bag stand herein shown and disclosed in detail is fully capable of attaining the objects and providing the advantages hereinbefore stated, it is to be understood that it is merely illustrative of the presently preferred embodiment thereof and that no limitations are intended to the detail of construction or design herein shown other than as defined in the appended claims.

What is claimed is:

1. A golf bag leg support for optional use on a lady's-sized golf bag or a man's-sized golf bag consisting of a tripod arrangement of a golf bag and two cooperating golf bag-supporting legs actuated from a normally closed position against said golf bag into an open golf bag-supporting position in response to a sliding movement of a leg-opening slide member from an upper to a lower sliding position of movement vertically along each said golf bag, an improved tracking means of said leg-opening slide member comprising a slide bracket of a curved shape adapted to fit against a correspondingly curved shaped surface adjacent an upper end of said golf bag, said slide bracket having spaced apart opposite sides bounding a clearance therebetween and a raised rectangular medial section having extending laterally therefrom to bound a detent pin-receiving chamber therebeneath and in said clearance between said opposite sides and a facing side of said rectangular medial section having two parallel vertically oriented tracks, and said leg-opening slide member operatively disposed for sliding movement on a slide bracket, said slide having two opposite side projections shaped and sized to extend into a cooperating one of each of said vertically oriented tracks and having a connecting medial portion in covering relation over a slide bracket rectangular medial section, a cooperating interconnecting detent pin on said slide medial portion and upper and lower detent pin-engagable female openings into said detent pin-receiving chamber beneath said slide bracket rectangular medial section for selectively holding said upper and lower positions of sliding movement of said slide relative to said slide bracket, said positions of movement being effective for positioning a depending end of said leg-opening slide member beyond a bottom of a cooperating golf bag a first smaller extent for a lady-sized golf bag and at a second larger extent for a man's-sized golf bag, said lower position of movement being an operative position at which there is ground contact and said upper position of movement being an operative position at which there is no ground contact, and on said slide bracket having lower and upper position-holding means in specific form of said detent pin-engagable female openings, said lower female opening being of a circular configuration providing a single position and said upper female opening being of an elongated slot configuration providing plural positions, whereby the degree of sliding movement permitted in said slot accounts for said lady's and man's golf bag size differences.

* * * * *